US009076351B2

(12) United States Patent
Vafadari et al.

(10) Patent No.: US 9,076,351 B2
(45) Date of Patent: Jul. 7, 2015

(54) PALLET AND CRATE SEAL AND METHOD FOR SECURING A PALLET OR CRATE

(71) Applicant: Koorosh Vafadari, Katy, TX (US)

(72) Inventors: Koorosh Vafadari, Katy, TX (US); Terry Mauger, St. Charles, IL (US)

(73) Assignee: Koorosh Vafadari, Katy, TX (US)

( * ) Notice: Subject to any disclaimer, the term of this patent is extended or adjusted under 35 U.S.C. 154(b) by 0 days.

(21) Appl. No.: 13/915,352

(22) Filed: Jun. 11, 2013

(65) Prior Publication Data

US 2014/0077509 A1 Mar. 20, 2014

Related U.S. Application Data

(63) Continuation-in-part of application No. 13/463,195, filed on May 3, 2012.

(60) Provisional application No. 61/519,818, filed on May 31, 2011.

(51) Int. Cl.

| | |
|---|---|
| ***B65D 27/30*** | (2006.01) |
| ***G09F 3/03*** | (2006.01) |
| ***B65D 63/06*** | (2006.01) |
| *B65D 33/34* | (2006.01) |

(52) U.S. Cl.

CPC ..... *G09F 3/03* (2013.01); *G09F 3/0323* (2013.01); *B65D 63/06* (2013.01)

(58) Field of Classification Search

CPC ..... E05B 67/00; G09F 3/03; G09F 3/0305; G09F 3/0341; G09F 3/0347

USPC ..... 292/307 R, 307 B; 70/14, 50, 57, 57.1, 70/58, 63; 24/23 R, 23 W, 23 B, 23 EE, 633

See application file for complete search history.

(56) References Cited

U.S. PATENT DOCUMENTS

| | | | | | |
|---|---|---|---|---|---|
| 946,486 | A | * | 1/1910 | Brassington | 292/325 |
| 1,080,823 | A | * | 12/1913 | Freschl | 292/325 |
| 1,354,165 | A | * | 9/1920 | Brooks | 292/325 |
| 1,678,955 | A | * | 7/1928 | Rockenbauer | 292/307 B |

(Continued)

FOREIGN PATENT DOCUMENTS

| | | | |
|---|---|---|---|
| DE | 3404174 | A1 | 7/1984 |
| JP | 2001-502559 | A | 2/2001 |
| JP | 2002-030840 | A | 1/2002 |

OTHER PUBLICATIONS

USPTO NFOA dated Jun. 4, 2013 in connection with U.S. Appl. No. 13/463,195.

(Continued)

*Primary Examiner* — Carlos Lugo

(74) *Attorney, Agent, or Firm* — Ladas & Parry LLP

(57) ABSTRACT

Method and apparatus for securing a pallet, crate, or similar shipping containers against pilferage using a pallet seal including one or more parts, and having one or more locking devices are included. The seal can be secured against the clip on the pallet banding, completely covering and protecting the clip from tampering. The seal can have specific seal number and marking, color, or other features that makes it almost impossible to duplicate. Further the seal can have the capability to include RFID tags, Bar Code, and or custom marking and can be applied to the banding clips without a use of any tool or secondary seal or number.

8 Claims, 7 Drawing Sheets

(56) References Cited

U.S. PATENT DOCUMENTS

| | | | | | |
|---|---|---|---|---|---|
| 1,952,085 | A | * | 3/1934 | Mayer | 40/628 |
| 2,048,424 | A | * | 7/1936 | Caldwell | 70/232 |
| 2,816,337 | A | | 12/1957 | Gerrard et al. | |
| 3,072,986 | A | | 1/1963 | Lefnaer | |
| 3,224,055 | A | | 12/1965 | Orser | |
| 3,331,106 | A | | 7/1967 | Ruskin | |
| 3,744,104 | A | * | 7/1973 | Ford | 24/543 |
| 3,800,450 | A | * | 4/1974 | Laugherty et al. | 40/633 |
| 3,906,591 | A | | 9/1975 | Boiardi | |
| 3,999,409 | A | | 12/1976 | Bell | |
| 4,057,983 | A | | 11/1977 | Morgan | |
| 4,146,242 | A | | 3/1979 | Bose | |
| 4,474,116 | A | | 10/1984 | Castenada, Jr. et al. | |
| 4,483,049 | A | | 11/1984 | Gustavsson et al. | |
| 4,649,397 | A | | 3/1987 | Heaton et al. | |
| 4,674,303 | A | | 6/1987 | Salcone, II | |
| 4,731,912 | A | | 3/1988 | Boriskie et al. | |
| 4,878,277 | A | | 11/1989 | Portuese | |
| 4,961,251 | A | | 10/1990 | Smith | |
| 4,987,662 | A | | 1/1991 | Haffey et al. | |
| 5,129,129 | A | | 7/1992 | Collins et al. | |
| 5,181,402 | A | * | 1/1993 | Faessler et al. | 70/18 |
| 5,189,767 | A | | 3/1993 | Reitsma | |
| 5,222,776 | A | | 6/1993 | Georgopoulos et al. | |
| 5,548,878 | A | | 8/1996 | Romagnoli | |
| 5,577,395 | A | * | 11/1996 | Kuykendall | 63/3 |
| 5,655,802 | A | | 8/1997 | Topp et al. | |
| 5,683,404 | A | | 11/1997 | Johnson | |
| D396,736 | S | | 8/1998 | Davis | |
| 5,788,294 | A | | 8/1998 | Leon et al. | |
| 5,979,095 | A | * | 11/1999 | Schneider et al. | 40/633 |
| 6,041,480 | A | | 3/2000 | White | |
| 6,128,932 | A | * | 10/2000 | Mainetti et al. | 70/57.1 |
| 6,279,358 | B1 | | 8/2001 | Costa | |
| 6,311,531 | B1 | | 11/2001 | Sykes | |
| 6,360,411 | B1 | * | 3/2002 | Bortz | 24/704.2 |
| 6,612,139 | B1 | | 9/2003 | Costa | |
| 6,754,939 | B2 | * | 6/2004 | Belden et al. | 24/704.1 |
| 6,948,746 | B2 | * | 9/2005 | Brammall et al. | 292/315 |
| 7,526,931 | B2 | | 5/2009 | Burdett et al. | |
| 7,626,501 | B2 | | 12/2009 | Feibelman | |
| 2004/0083778 | A1 | | 5/2004 | Loeff et al. | |
| 2007/0295039 | A1 | | 12/2007 | Belden, Jr. | |
| 2008/0178434 | A1 | | 7/2008 | Bulanda | |
| 2008/0209958 | A1 | | 9/2008 | Visotcky | |
| 2010/0126238 | A1 | | 5/2010 | Mazzucchelli | |

OTHER PUBLICATIONS

International Search Report mailed Feb. 6, 2013; PCT/US2012/067711.

* cited by examiner

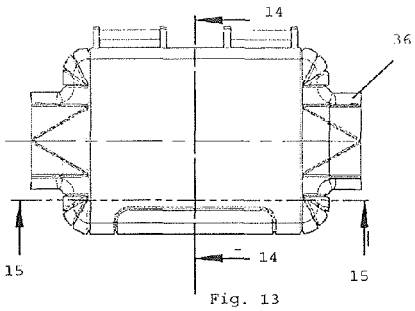
Fig. 13
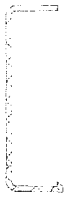
Fig. 14
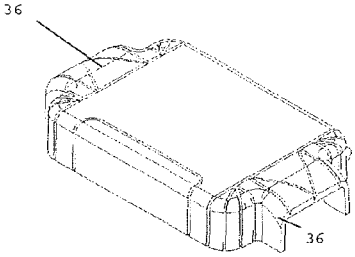
Fig. 19
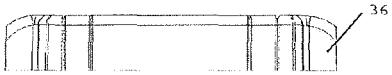
Fig. 17
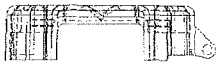
Fig. 18
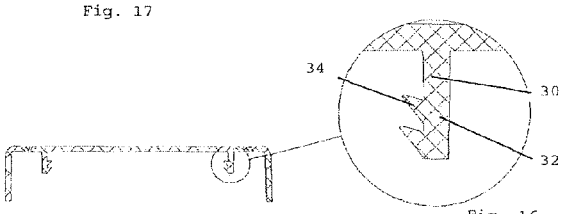
Fig. 15
Fig. 16

PALLET AND CRATE SEAL AND METHOD FOR SECURING A PALLET OR CRATE

CROSS REFERENCE TO RELATED APPLICATIONS

The present application is a continuation in part of claims priority to co-pending U.S. application Ser. No. 13/463,195 filed May 3, 2012, which itself claims priority to co-pending U.S. application Ser. No. 61/519,818 filed on May 31, 2011.

FIELD

The present embodiments relate to securing a shipping pallet or crate.

BACKGROUND

A need exists for a method or an apparatus to properly secure the clip on the banding used on pallets and crates in order to prevent tampering of its contents.

Everyday billions of dollars in goods are shipped around the world via air, ocean, truck, or rail Security and protection of cargo is a major issue for shippers, carriers, insurance companies, end-users, and now TSA and national security.

Therefore, a need exists for an apparatus that allows shippers to protect cargo, maintain chain of custody through special and unique serial numbering, prevent clip from attack, and can be applied to existing clips on banding without use of a tool.

Therefor a need exists for an apparatus to secure and protect the contents of pallet and crate shipments from pilferage.

The present embodiments meet these needs.

BRIEF DESCRIPTION OF THE DRAWINGS

The detailed description can be better understood in conjunction with the accompanying drawings as follows:

FIG. 13: Top plan view of a cover in an embodiment of a pallet and crate seal FIG. 14: End Cross-Section view of a cover in an embodiment of a pallet and crate seal taken at line 14-14 of FIG. 13

FIG. 15: Frontal Cross-Section view of a cover in an embodiment of a pallet and crate seal taken at line 15-15 of FIG. 13

FIG. 16: Enlarged view of a barbed lock

FIG. 17: Front elevation of a cover in an embodiment of a pallet and crate seal FIG. 18: End elevation of a cover in an embodiment of a pallet and crate seal FIG. 19: Perspective view of a cover in an embodiment of a pallet and crate seal

DETAILED DESCRIPTION OF THE EMBODIMENTS

Before explaining the present apparatus in detail, it is to be understood that the apparatus is not limited to the particular embodiments and that it can be practiced or carried out in various ways.

The present embodiments relate to a pallet and crate seals which can be applied to a banding clip in order to secure the banding and hence the pallet or crate.

While these embodiments have been described with emphasis on the embodiments, it should be understood that within the scope of the appended claims, the embodiments might be practiced other than as specifically described herein.

The G2G Pallet Seal can have one, two or more sections of plastic, metal, or other suitable material, with either a male and female part or a single locking part which can enclose and protect the pallet clip. The size of the seal produced can vary depending on the size of the clip being applied to the banding.

Each seal can have one or more parts that when applied can create a self-locking device protecting the clip on the band. The current two-piece version showed has interlocking male and female parts.

Once the clip has been securely positioned inside the seal, then the seal can be closed by applying pressure to the top and bottom portion of the seal allowing the locking devices to engage and secure the seal.

After the clip has been applied to a banding on a pallet or crate, then the G2G Seal can be applied to the clip by simply sliding it under the clip until the clip is situated inside the seal and then the seal is closed.

A special barcode and or serial numbering prevent duplication of the seal. Once the seal is closed the clip cannot be attacked and hence the banding is secured. The banding can now be removed only by cutting the banding and the clip cannot be accessed unless by destroying the seal hence indicating tampering.

Figure 1:
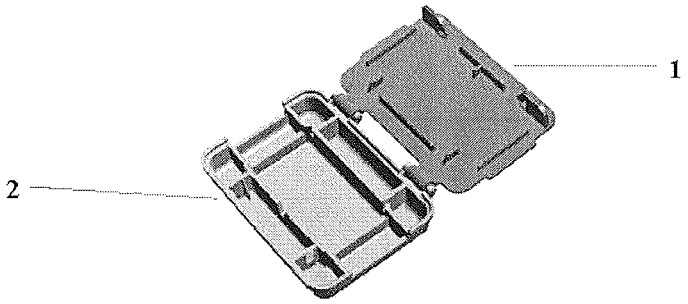
FIG. 1: Pallet and Crate Seal—Open view of Cover and Base

FIG. 1 depicts an embodiment of the seal to include a Cover 1 and a Base 2.

Figure 2:
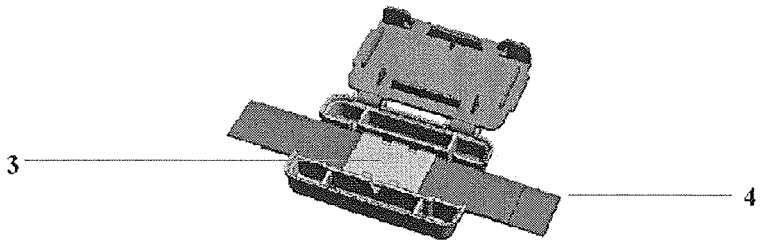
FIG. 2: Open view of band and clip situated inside the seal
Figure 3:
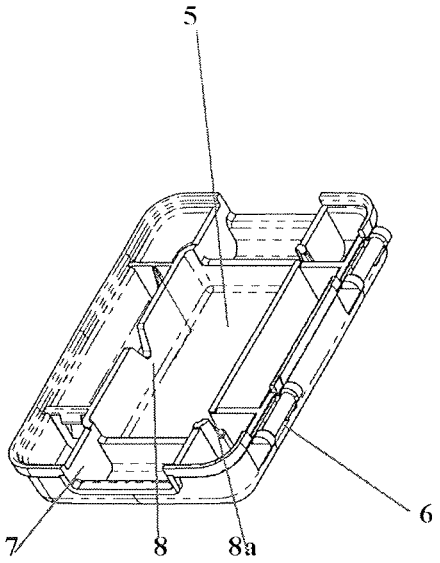
FIG. 3: Open view of Seal Base

In FIG. 2 the Clip 3 is applied to Banding 4 arid placed inside the designated location inside recessed area 5 of seal base as indicated in FIG. 3.

FIG. 3 shows the recessed area 5 where the clip will reside. Further hinge 6 allows easy movement of Cover 1 and Base 2 to allow seal to close without breaking before application. In addition interior wall 7 protects against attempts to pick the locking system from the opening where banding is passed through Base 2. Finally a special cavity 8 is added so that fin 23 shown in FIG. 9 can rest to secure against side to side movement.

Figure 4:
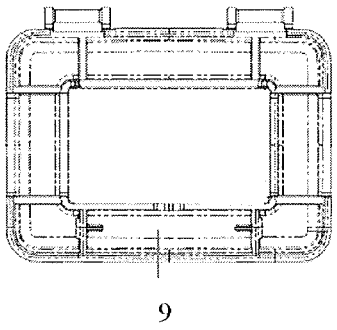
FIG. 4: Top view of Seal Base

In FIG. 4 which is the top view of the seal Base 2, we can clearly see the locking system being protected in area 9 with interior wall 7 preventing tampering.

Figure 5:
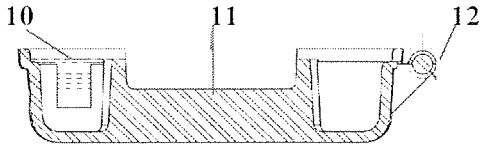
FIG. 5: End Cross-Section view of Seal Base showing hinge, landing, and lock

Cross section of FIG. 5 of Seal shows the Seal Cover 1 recessed into Seal Base 2. Further clip landing area 11 is shown as well as closed hinge 12 which allows for easy closer of seal and prevents against tampering. The closed hinge 12 is constructed using special material that will break if a screw driver or another object is used to force open the seal, hence indicating tampering.

Figure 6:
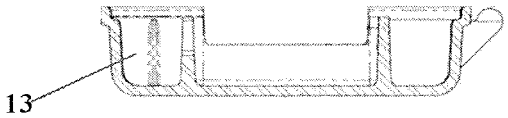
FIG. 6: End Cross-Section view of Seal Base showing locking features
Figure 8:
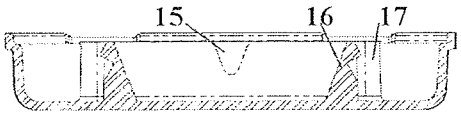
FIG. 8: Frontal Cross-Section view displaying locking system

Once the seal is closed in FIG. 6, 13 shows the locking system cross section as a result of the female locking body 17 shown in FIG. 8 on seal Cover 1 being forced down into Base 2 engaging with the hook on the male locking part 16 in FIG. 8.

Figure 7:
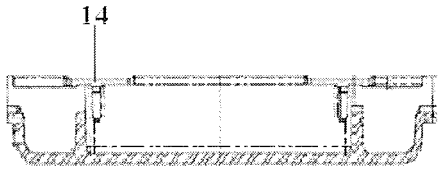
FIG. 7: Frontal Cross-Section view displaying Cover security fin

In FIG. 7 the seal Cover 1 has protruding fins 14 that when seal is closed is lowered into the inside section of seal Base 2 recessed area 5, pushing against interior wall 7. This helps prevent any tampering of the locking system through banding entrance and keeps the Clip 3 secure in the recessed area 5.

Once the seal is closed in FIG. 8, male fin 15 on seal Cover 1 is placed in the special Cavity 8 in Base 2 and female locking body 17 is locked into male locking part 16 forming the closed seal.

Figure 9:
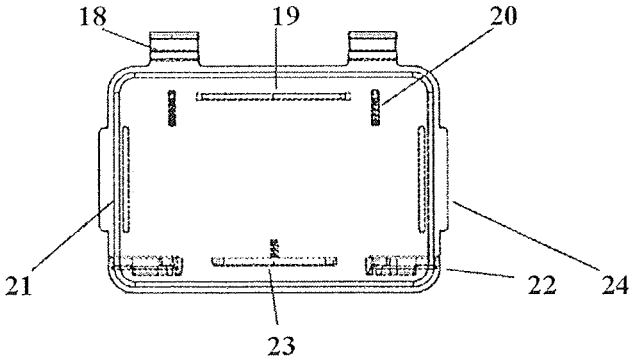
FIG. 9: Top view of Seal Cover showing various security features
Figure 10:
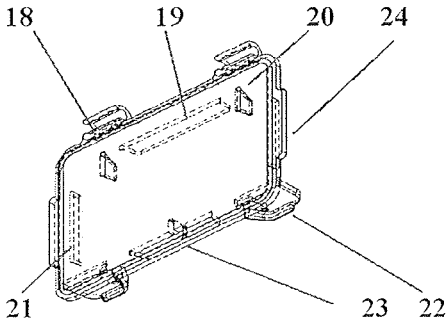
FIG. 10: Side view of Seal Cover showing various security features

FIG. 9 depicts a view while FIG. 10 shows the side view of the bottom of the seal Cover 1 showing various security features. Curved top portion of the hinge 18 is inserted into bottom hinge portion 6 forming the complete hinge 12. Two security walls 23 and 19 the same as in shown in 14 protect the locking and hinge mechanism from attack. Upon seal closure special security fin 20 lands in special cavity recess 8*a* in FIG. 3. This prevents the cover 1 from moving in Base 2 and the fin will break if attempt is made to force the cover off therefore indicating tampering. Special protruded wall 21 on Cover 1 is pushed against the banding 4 eliminating any gap between the Banding 4 and the seal body therefore eliminating access to Clip 3. The inner walls of recessed area 5 along with this protruded wall 21 will hold the Clip 3 securely in place in recessed area 5. The female locking arm 22 that is the same as 17 shown in FIG. 8 is shown to secure the lock. Finally the extended lip 24 which is located on both seal Cover 1 and Base 2 will extend the seal security body.

This helps prevent any used of screw driver or tool to try and force the clip 3 from its recessed area 5. If an attempt is made the extended lip 24 will indicate tampering.

Figure 11:
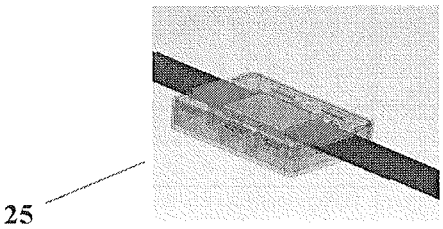
FIG. 11: View of Seal showing applied clip to banding

FIG. 11 shows the closed and applied seal showing the Clip 3 enclosed in the seal 25. The seal can also have unique markings, bar coding, coloring, and numbering in addition to optional RPID or other security measure in order to prevent counterfeiting or tampering.

Figure 12:
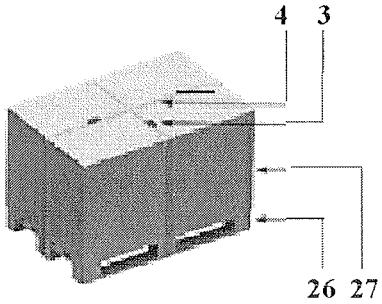
FIG. 12: Shows a typical pallet or crate and location of banding and clip
Figure 20:
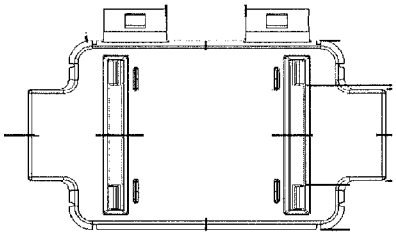
FIG. 20: Top plan view of a base in an embodiment of a pallet and crate seal

FIG. 12 indicates location of a typical Pallet 26 or Crate 27 containing the Clip 3 and Banding 4.

FIG. 13-19 illustrate the cover for an alternative embodiment of a pallet and crate seal in which barbed locks and a protective flange are formed and arranged. FIG. 14 shows the opening in the body which receives the pallet strap buckle or lock. FIG. 15 shows a series of barbed locks, with FIG. 16 providing an enlarged view of barbed lock 30 showing a downwardly projecting leg 32 with acutely angled projections 34 that will securely lock and resist opening. FIGS. 13, 17, 18 and 19 additionally illustrate projecting flanges 36 that have a top portion and side wall portions that project over the band or strap and provide protection against access such as by prying tools to the interior.

Figure 21:
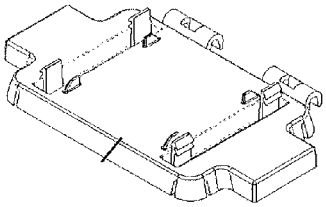
FIG. 21: Perspective view of a base in an embodiment of a pallet and crate seal
Figure 22:
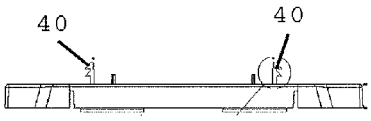
FIG. 22: Front elevation of a base in an embodiment of a pallet and crate seal
Figure 24:
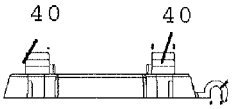
FIG. 24: End view of a base in an embodiment of a pallet and crate seal The present embodiments are detailed below with reference to the listed Figures.
Figure 23:
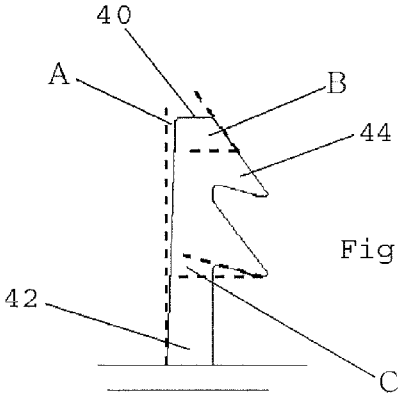
FIG. 23: Enlarged view of a barbed lock

FIG. 20-24 illustrate the base for an alternative embodiment of a pallet and crate seal in which barbed locks and projecting tabs are formed and arranged. FIG. 21 shows the projecting tabs which form a floor of the opening in the closed seal which receives the pallet strap buckle or lock and over which the protective flange fits. FIGS. 22 and 24 show pairs of barbed locks, with FIG. 23 providing an enlarged view of barbed lock 40 showing a updownwardly projecting leg 42 with acutely angled projections 44 that will engage projections 34 when closed to securely lock and resist opening of the cover and base assembly. Preferably leg 42 has angled A of about two degrees, plus or minus about one degree towards projections 44. The upper face of projections 44 at angle B are about 54 degrees from horizontal, plus or minus about two degrees. The engagement face of projections 44 at angle C are about 15 degrees from horizontal, plus or minus about two degrees.

When cargo is ready to be shipped boxes are usually placed on a pallet, crate or containers, and then banding is secured by a metal clip and applied to secure the cargo. After the banding is applied then the seal is applied to the clip enclosing and protecting the clip. The seal is now secured and cannot be removed except by destroying the seal or cutting the banding where tampering of cargo is indicated.

The locking system has been designed in a way to provide maximum protection against tampering. Features have been included that can prevent tampering using common tools. Material used to produce the product can include measure to prevent use of acids, or Freon to defeat the locking system.

Other measure such as bar coding, use of clear polycarbonate material, special marking and or bar codes, can provide additional security measures.

The above described embodiments of the present invention thereby accomplish the 20 stated objectives by providing substantial theft proof method and apparatus for sealing shipping pallets, crates, and similar shipping containers.

While the invention has been described, disclosed, illustrated and shown in certain terms or certain embodiments or modifications that it has assumed in practice, the scope of the invention is not intended to be nor should it be deemed to be limited thereby and such other modifications or embodiments as may be suggested by teachings herein are particularly reserved especially as they fall within the scope of the breadth and scope of the claims here appended

What is claimed is:

1. A security seal adapted to be attached to a shipping strap, comprising:

a base including an interior wall defining an interior area;

at least one projecting flange, where the shipping strap passes through the seal;

at least one barbed base locking device;

a cover having at least one barbed cover locking device configured to engage with the at least one barbed base locking device;

wherein the interior wall is configured to prevent tampering of the engagement of the at least one barbed base locking device and the at least one barbed cover locking device;

wherein the security seal is removable only by destroying the security seal and includes at least one of a unique marking and a serial number.

2. The security seal of claim 1, where the security seal encapsulates a clip on the shipping strap.

3. The security seal of claim 2, wherein the interior area is a recessed area and the clip is secured within the recessed area by the interior wall.

4. The security seal of claim 1, where the base and the cover each have special identification means that are unique, either related or unrelated to each other.

5. The security seal of claim 1, wherein the interior area is a recessed area.

6. The security seal of claim 1, wherein the cover is pivotally mounted to the base.

7. The security seal of claim 1, wherein the engagement of the at least one barbed base locking device and the at least one barbed cover locking device is isolated from a banding entrance defined in the projected flange by the interior wall.

8. A method of protecting a shipment on a Pallet, crate, or similar shipping containers from pilferage by applying a security seal that encapsulates a strapping clip securing the Pallet comprising:

positioning a base of the security seal having at least one barbed base locking device between the pallet wall and a pallet strapping and a clip on the pallet strapping such that the clip is disposed in an interior area of the base defined by an interior wall; and positioning a cover having at least one barbed cover locking device so as to engage with the at least one barbed base locking device;

wherein the interior wall is configured to prevent tampering of the engagement of the at least one barbed base locking device and the at least one barbed cover locking device.

* * * * *